US005269435A

United States Patent [19]

Hallock, III

[11] Patent Number: 5,269,435

[45] Date of Patent: Dec. 14, 1993

[54] GARBAGE PAIL

[76] Inventor: Orrin S. Hallock, III, 33 Robaots Rd., Cambridge, Mass. 02138

[21] Appl. No.: 950,029

[22] Filed: Sep. 24, 1992

[51] Int. Cl.[5] ..... B65D 90/04

[52] U.S. Cl. ..... 220/404; 220/908

[58] Field of Search ..... 220/404, 908, 403, 402; 248/99, 101

[56] References Cited

U.S. PATENT DOCUMENTS

| | | | |
|---|---|---|---|
| 1,026,081 | 5/1912 | Dorais | 220/404 X |
| 3,487,989 | 1/1970 | Rausing et al. | 220/404 X |
| 3,964,630 | 6/1976 | Getz | 220/404 |
| 4,238,868 | 12/1980 | Sternberg | 248/101 X |
| 4,444,355 | 4/1984 | Cary | 220/908 X |
| 4,558,799 | 12/1985 | Hammond | 220/908 X |
| 4,715,572 | 12/1987 | Robbins, III et al. | 220/404 X |
| 4,753,367 | 6/1988 | Miller et al. | 220/404 |
| 4,765,579 | 8/1988 | Robbins, III et al. | 220/404 X |
| 4,913,308 | 4/1990 | Culbertson | 220/404 |
| 4,940,159 | 7/1990 | Callas et al. | 220/404 |
| 4,953,740 | 9/1990 | Koda | 220/263 |
| 4,953,744 | 9/1990 | Koyama | 220/404 |
| 4,955,566 | 9/1990 | Bolich | 248/101 |
| 5,028,022 | 7/1991 | Metcalf | 248/95 |
| 5,119,960 | 6/1992 | Robbins, III | 220/908 X |

*Primary Examiner*—Allan N. Shoap
*Assistant Examiner*—Stephen Cronin

[57] ABSTRACT

The object of the present invention is to provide a garbage pail that has liner holding features for utilizing common disposable shopping bags as liners, Said garbage pail comprised of an open mouth container 1 the mouth of the container has a seperate removable liner holding inwardly folding perimeteral lip 7 comprised of two C shaped members secured to opposing sides of the mouth of the container for holding the mouths of paper shopping bags or plastic liner bags open against the walls of the holding cavity of the garbage pail.

1 Claim, 1 Drawing Sheet

GARBAGE PAIL

DESCRIPTION

1. Technical Field

The present invention relates to domestic waste receptacles for the collection, containment and temporary storage of household rubbish and to commercial paper and plastic shopping bags.

2. Background Art

In the present industrialized world it is possible to purchase a vast array of domestic garbage pails. Most household waste pails are used in conjunction with disposable liners few are designed and constructed to hold the same open, and prevent refuse from getting between the liner and the inner walls of the container.

DISCLOSURE OF INVENTION

In accordance with the present invention there is provided a garbage pail comprised of an open mouth container. The mouth of the holding cavity of the container has an inwardly folding perimeteral lip for holding open the mouths of paper shopping grocery bags inserted within the holding cavity open against the interior walls of the mouth of the container to prevent substances disposed within the container from getting outside the liner inbetween the liner and the container.

BRIEF DESCRIPTION OF DRAWINGS

The details of the present invention will be discussed in connection with the accompanying drawing, FIG. 1 which presents an exploded perspective view of a possible embodiment of the present invention.

BEST MODE FOR CARRYING OUT THE INVENTION

Figure 1:
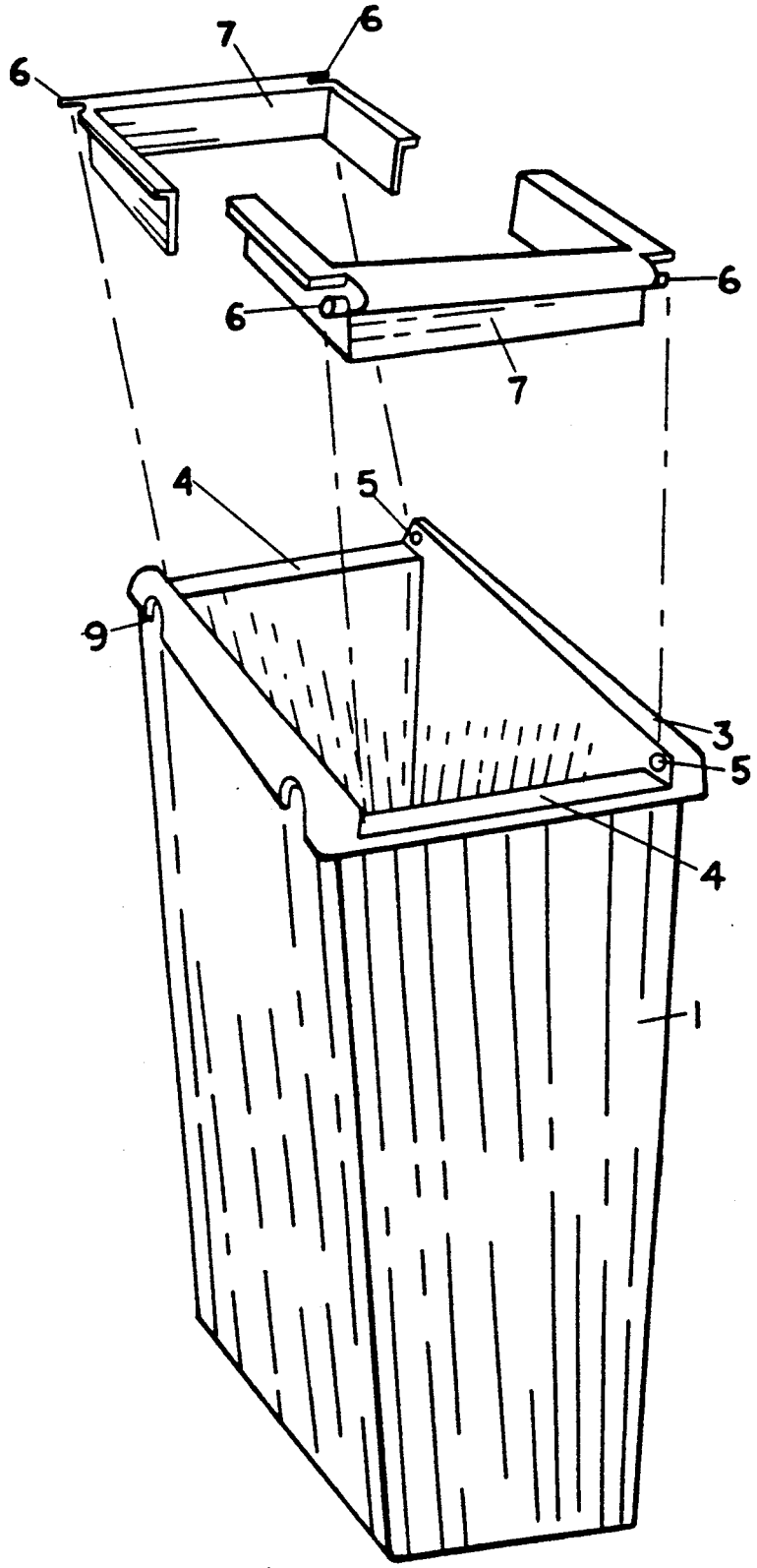

Referring now to the drawing FIG. 1 by reference characters there is shown an open mouth garbage pail 1 of molded plastic formed with a tapered base such that a plurality of containers can be stacked one inside the other when empty. The mouth of the container is molded with a downwardly extending collar 3 thereabout. The collar is formed with at least two notches 9 for hanging the container on the head of common fasteners secured in a wall or like surface. The collar of the mouth of the container is molded with recessed shelf 4 at either widthwise end. The opposing lateral defining walls of the recessed widthwise portions of the mouth of the container are formed with a perforation 5 each, for pivotly seating the integral hinge pins 6 molded at either end of the central length of a pair of liner holding C shaped members 7, and pivotly securing the C shaped liner holding members to the widthwise ends of the mouth of the container. The C shaped members are for holding the mouths of paper or plastic grocery bags open, between the inwardly pivoting C shaped members and the inner walls of the mouth of the container.

The present invention possesses the advantage of providing a domestic garbage pail that will except common disposable paper grocery bag and integral handled plastic grocery bags as disposable liners therefor, and will hold the mouths thereof open against the interior walls of the container, thus preventing undesirable material from falling between the liner and the interior walls of the container.

I claim:

1. A garbage pail comprising a substantially rigid container comprised of an upstanding sidewall, a closed bottom wall and an open mouth opposite said bottom wall, a perimeteral lip comprised of two U-shaped members conforming to and hinged to the mouth of the container each member extending into and covering a marginal portion of said mouth for retaining the upper edge of a paper shopping bag between the perimeterial lip and an interior surface of the container side wall.

* * * * *

UNITED STATES PATENT AND TRADEMARK OFFICE

CERTIFICATE OF CORRECTION

PATENT NO. : 5,269,435
DATED : December 14, 1993
INVENTOR(S) : Orrin S. Hallock, III It is certified that error appears in the above-indentified patent and that said Letters Patent is hereby corrected as shown below:

On title page, item [76] inventor's address should read
-- 33 Roberts Rd. Cambridge, Mass 02138--.

Signed and Sealed this
Sixth Day of September, 1994

*Attest:*

*Attesting Officer*

Bruce Lehman

BRUCE LEHMAN

*Commissioner of Patents and Trademarks*